US008884822B2

(12) United States Patent
DiNallo

(10) Patent No.: US 8,884,822 B2
(45) Date of Patent: Nov. 11, 2014

(54) ANTENNA SYSTEM FOR HANDHELD SATELLITE COMMUNICATION DEVICES

(75) Inventor: Carlo DiNallo, Plantation, FL (US)

(73) Assignee: Maxtena, Rockville, MD (US)

( * ) Notice: Subject to any disclaimer, the term of this patent is extended or adjusted under 35 U.S.C. 154(b) by 231 days.

(21) Appl. No.: 13/464,909

(22) Filed: May 4, 2012

(65) Prior Publication Data

US 2013/0120195 A1 May 16, 2013

Related U.S. Application Data

(60) Provisional application No. 61/482,761, filed on May 5, 2011.

(51) Int. Cl.
*H01Q 1/38* (2006.01)
*H01Q 1/24* (2006.01)
*H01Q 9/04* (2006.01)

(52) U.S. Cl.
CPC ..... *H01Q 9/0407* (2013.01); *H01Q 9/0428* (2013.01)
USPC ..... 343/700 MS; 343/702

(58) Field of Classification Search
CPC ..... H01Q 1/38; H01Q 1/48; H01Q 9/40; H01Q 9/407; H01Q 9/0421; H01Q 13/106; H01Q 9/065; H01Q 9/0428
See application file for complete search history.

(56) References Cited

U.S. PATENT DOCUMENTS

| | | | | |
|---|---|---|---|---|
| 3,972,049 | A * | 7/1976 | Kaloi | 343/829 |
| 5,241,321 | A * | 8/1993 | Tsao | 343/700 MS |
| 5,940,036 | A * | 8/1999 | Oliver et al. | 343/700 MS |
| 6,166,692 | A * | 12/2000 | Nalbandian et al. | 343/700 MS |
| 6,636,179 | B1 * | 10/2003 | Woo et al. | 343/700 MS |
| 6,759,990 | B2 * | 7/2004 | Rossman | 343/700 MS |
| 8,427,373 | B2 * | 4/2013 | Jiang et al. | 343/700 MS |
| 2007/0132640 | A1 * | 6/2007 | Kim et al. | 343/700 MS |
| 2009/0058733 | A1 * | 3/2009 | Kurashima et al. | 343/700 MS |
| 2012/0313828 | A1 * | 12/2012 | Yanagi et al. | 343/702 |

* cited by examiner

*Primary Examiner* — Trinh Dinh

(57) ABSTRACT

An antenna systems for a handheld wireless device comprises an antenna disposed proximate an oblong ground structure (e.g., oblong PCB). The antenna is suitably adapted to radiated circularly polarized waves by supporting quadrature phased first and second resonances which are associated with electrical fields oriented at right angles to each other and at an oblique angle relative to a longitudinal axis of the oblong ground structure.

3 Claims, 3 Drawing Sheets

400

ANTENNA SYSTEM FOR HANDHELD SATELLITE COMMUNICATION DEVICES

RELATED APPLICATION DATA

This application is based on provisional application 61/482,761 filed May 5, 2011

FIELD OF THE INVENTION

The present invention relates generally to antenna systems for handheld devices.

BACKGROUND

As modern societies' infrastructure and various operations (e.g., civilian and military) increasingly come to depend on ubiquitous always-on information system connectivity and intelligence, antennas have an important role to play.

Relentless progress in the field of microelectronics has exponentially increased processing speed and memory of handheld devices and allowed unprecedented levels of functionality. Connecting handheld devices with satellite communication systems, allows information and computation resources distributed over the globe to be leveraged by individuals in remote locals who are using powerful handheld devices. However, for this to be possible with a handheld device, antennas must be sized to fit a handheld device while at the same time attaining requisite high performance in terms of gain pattern and polarization purity.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
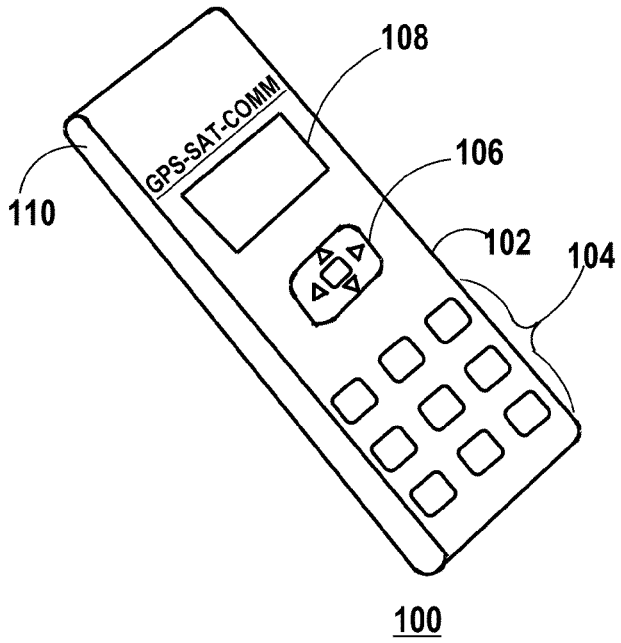
FIG. 1 is a perspective view of a handheld satellite communication device according to an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to antenna systems.

Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

It will be appreciated that embodiments of the invention described herein may be comprised of one or more conventional processors and unique stored program instructions that control the one or more processors to implement, in conjunction with certain non-processor circuits, some, most, or all of the functions of wireless communication described herein. The non-processor circuits may include, but are not limited to, a radio receiver, a radio transmitter, signal drivers, clock circuits, power source circuits, and user input devices. As such, these functions may be interpreted as steps of a method to perform wireless communication. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

FIG. 1 shows a handheld satellite communication device 100 according to an embodiment of the invention. The device 100 functions as a Global Positioning Systems (GPS) receiver, and may also function as a radio which can receive and/or transmit voice, text, video or other forms of useful data. The device 100 includes a housing 102, which supports a keyboard 104, a directional touchpad 106 and a display 108. A small upper portion 110 of the housing 102 encloses an antenna board 204 (FIG. 2).

Figure 2:
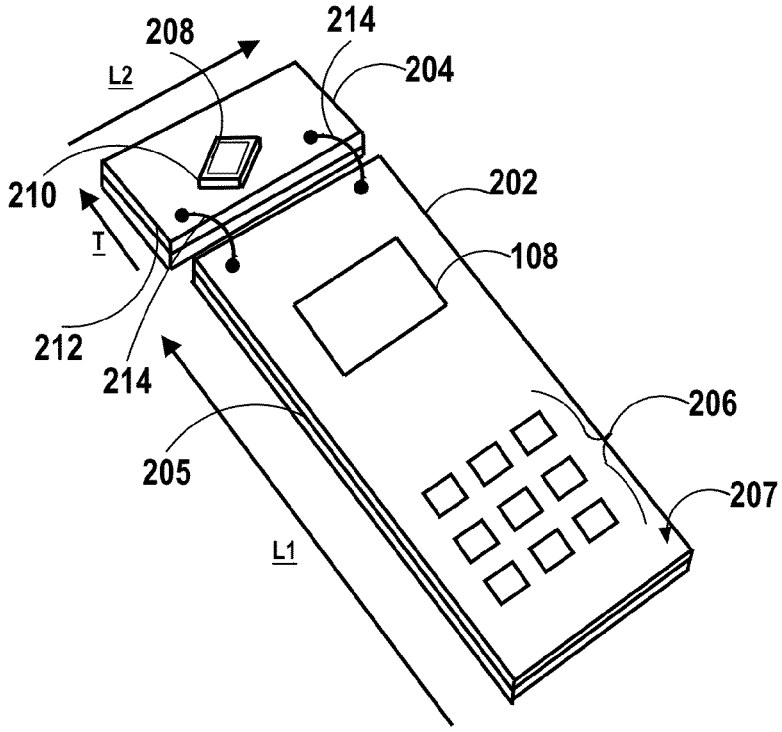
FIG. 2 is a perspective view of circuit boards, including an antenna board and a main board, that are incorporated in the device shown in FIG. 1.

FIG. 2 is a perspective view of circuit boards 202, 204, including a main board 202 and the antenna board 204 that are housed in the housing 102. As shown in FIG. 2 a front side 207 of the main board 202 includes capacitive metallization pads 206 for the keyboard 104 and supports the display 108. A reverse side of the main board 202 not visible in FIG. 2 is used to support circuit components such as discrete devices (e.g., resistors, diodes capacitors) and integrated circuits. The main board 202 is partly electrically conductive and includes one or more metallization layers that serve as ground plane layers 205. The one or more ground planes layers 205 of the main board 202 also form a part of an antenna system, which also includes the antenna board 204. The antenna board 204 and the main board 202 need not be co-planar as shown in FIG. 2.

The antenna board 204 is oblong and has a longitudinal axis 'L2' that is perpendicular to a longitudinal axis of the communication device 100 and perpendicular to a longitudinal axis 'L1' of the main board 202. A transverse axis 'T' of the antenna board 204 is perpendicular to the longitudinal axis 'L2' of the antenna board. A rectangular antenna patch 208 is supported over the antenna board 204 by a dielectric support 210. The rectangular antenna patch 208 may be square shaped. The dielectric support 210 has a plan view shape that is slightly larger but congruent with the shape of the antenna patch 208. The antenna patch 208 has its rectangular shape oriented in a common orientation with the dielectric support 210 and slightly off center, closer to one edge of the dielectric support 210 in the plan view. Offsetting the patch 208 creates a frequency difference between two orthogonal modes supported by the patch and this frequency difference leads to quadrature phase difference between the two orthogonal modes when the patch is driven at a frequency intermediate the frequencies of the resonant modes. The antenna patch 208 is oriented obliquely relative to the longitudinal axis 'L2' of the antenna board 204, preferably at an angle between 40° and 50°, and more preferably at 45°. The antenna board 204 includes a ground plane layer 212. The ground plane layer 212 is connected by a pair of conductive bridges 214 to the one or more metallization layers of the main board 202, e.g., to the ground plane layer 205. The conductive bridges 214 can, for example, take the form of miniature coaxial cable (as shown in FIG. 2) or alternatively as pieces of flex circuitry (not shown). In the case of coaxial cable the outer conductor can be used to connect to the ground plane layer 212, and the inner conductor can be used to feed the antenna patch 208.

Figure 3:
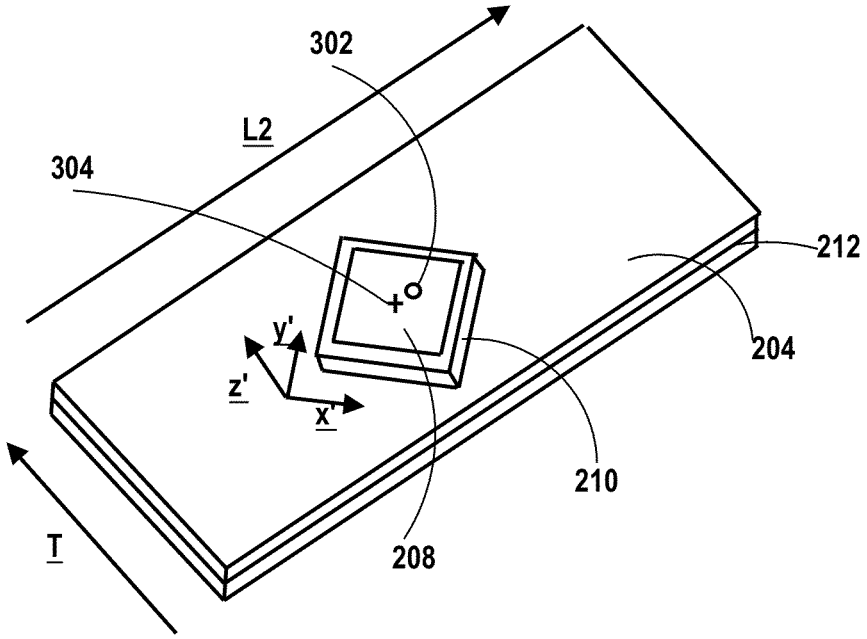
FIG. 3 is a perspective view of the antenna board shown in FIG. 2.

FIG. 3 is a perspective view of the antenna board 204 shown in FIG. 2. In FIG. 3 X'-Y'-Z' Cartesian coordinate axes are shown superimposed on the antenna board 204. The X'-axis and the Y'-axis are angled 45° away (in opposite directions) from the longitudinal axis 'L2' of the antenna board 204. In operation the antenna patch 208 supports a first electromagnetic resonance mode that produces an electric field oriented in the X'-axis direction and also supports a second electromagnetic resonance mode that produces an electric field oriented in the Y'-axis direction. The first resonance and the second resonance are in phase quadrature meaning that there is a one-quarter cycle phase delay between a time that the first resonance reaches its maximum and a time that the second resonance reaches its maximum. The foregoing phasing leads to the antenna patch 208 radiating a circularly polarized electromagnetic field. A feed pin 302 connects to a location of the antenna patch offset from a geometric center 304 of the antenna patch. Offsetting the pin matches the impedance of the antenna patch 208 to the signal feed, e.g., 402 (FIG. 4).

The antenna board 204 is accommodated in the upper portion 110 of the housing 102.

Figure 4:
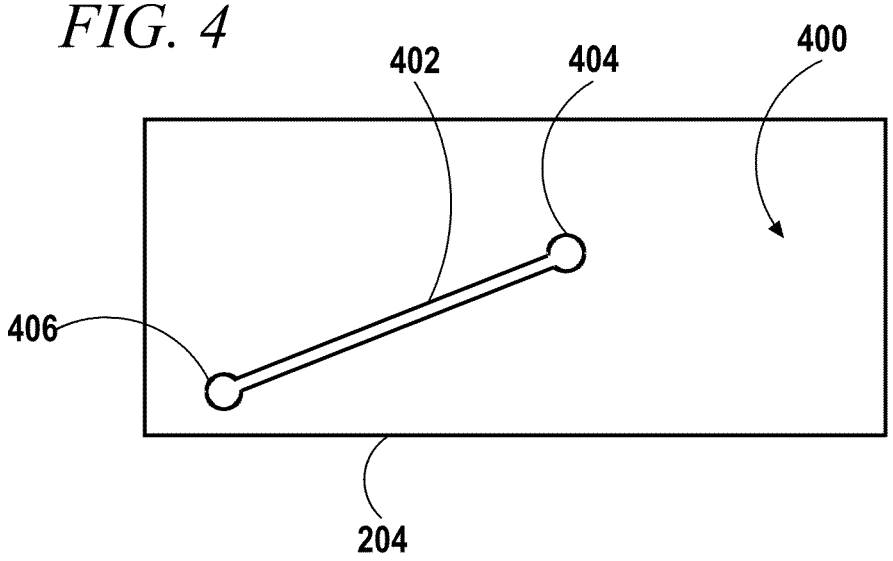
FIG. 4 is a plan view of a reverse side of the antenna board shown in FIG. 2 and FIG. 3.

FIG. 4 is a plan view of a reverse side 400 of the antenna board 204 shown in FIG. 2 and FIG. 3. The antenna board 204 includes a trace 402 that is used to connect to the feed pin 302 that feeds the antenna patch 208. A first end 404 of the trace 402 connects through a first via (not shown) to the feed pin 302. A second end 406 of the trace 402 connects through a second via (not shown) to one of the conductive bridges 214, for example to an inner conductor of a miniature coaxial cable that embodies the conductive bridge 214.

Figure 5:
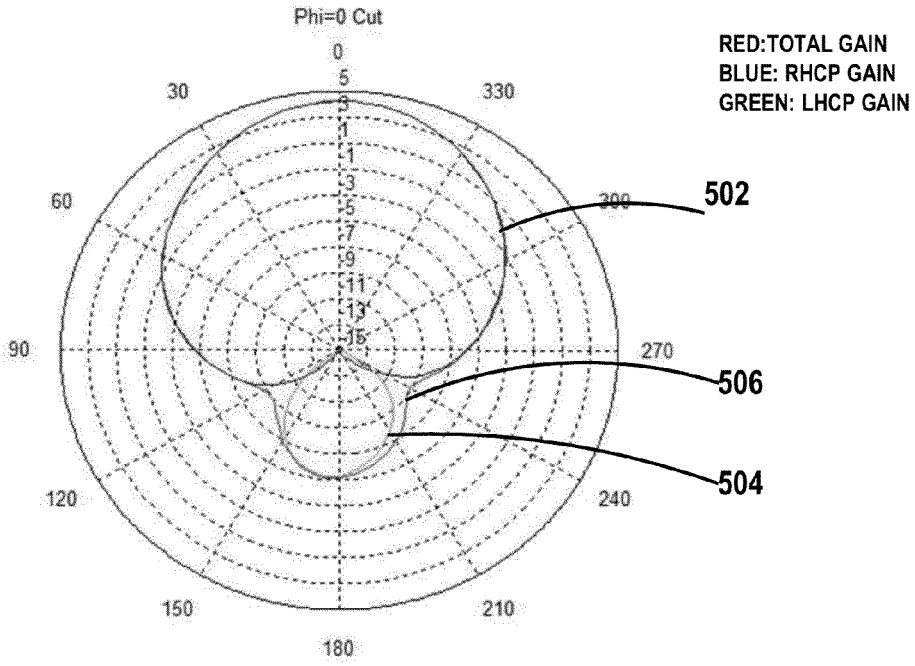
FIG. 5 is a graph including polar gain plots for RHCP, LHCP modes along with a plot for the summed gain.

FIG. 5 is a graph 500 including polar gain plots for RHCP 502, LHCP 504 modes along with a plot for the summed gain 506. As seen in FIG. 4 the RHCP is dominant in the upward facing hemisphere, and there is a weak LHCP lobe in the downward facing hemisphere. The Z' axis shown in FIG. 3 corresponds to 0° of the graph 500.

Figure 6:
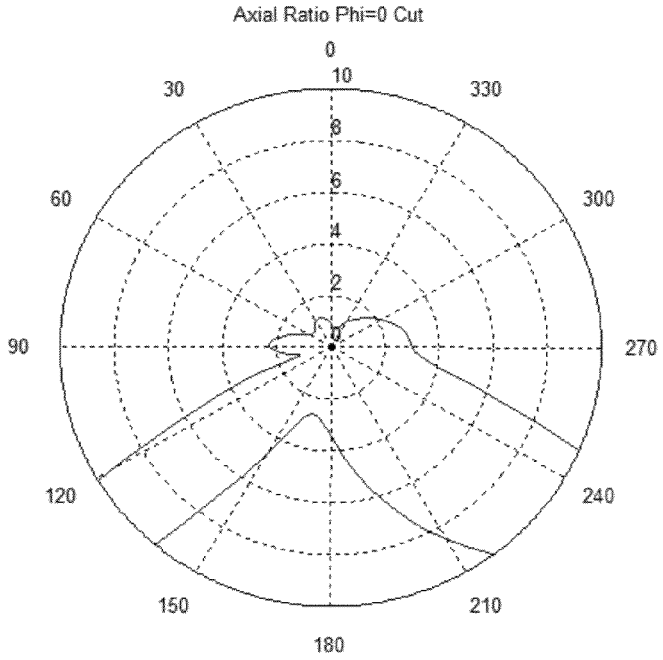
FIG. 6 is a graph of the axial ratio for the antenna shown in FIG. 2.

FIG. 6 is a graph of the axial ratio for the antenna shown in FIG. 2. The axial ratio shown in FIG. 6 is defined as the ratio of major and minor axes of the ellipse that describes the E-field magnitude as a function of polar angle about the wave propagation direction and is expressed in dB. For a perfectly circularly polarized wave the ratio of the major and minor axes is unity and the ellipse reduces to a circle. In the case of linearly polarized wave the axial ratio would be infinite.

As used in the present specification the "oblique" means an angle not equal to 0°, not equal to 90° and not equal to a multiple of 90°.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. An antenna system comprising:

an oblong planar circuit board having a top side, a bottom side and a longitudinal axis;

a dielectric support having a first side and a second side, the dielectric support positioned on the top side of the oblong planar circuit board, with the first side of the dielectric support in contact with the top side of the oblong printed circuit board;

a rectangular antenna patch positioned on the second side of the dielectric support wherein the rectangular antenna patch has a geometrical center and supports two orthogonal modes, and wherein the rectangular antenna patch is mounted off center with respect to the dielectric support, and wherein the rectangular antenna patch is oriented obliquely with respect to the longitudinal axis at an angle between 40° and 50° with respect to the longitudinal axis;

a feed pin connected to a location on the rectangular antenna patch offset from the geometrical center of the rectangular antenna patch and coupled to a trace on the bottom side of the oblong planar circuit board; and a main board that is adjacent to the oblong planar circuit board, is larger than the oblong planar circuit board and is conductively coupled to the oblong planar circuit board.

2. The antenna system according to claim 1 wherein the rectangular antenna patch comprises a square shaped patch and the feed pin connected to the square shaped patch at a location displaced from a center of the square shaped patch.

3. The antenna system according to claim 2 wherein the rectangular antenna patch is oriented at 45° with respect to the longitudinal axis.

* * * * *